US006068370A

United States Patent [19]

Miller et al.

[11] Patent Number: 6,068,370

[45] Date of Patent: May 30, 2000

[54] FLUIDIC DELIVERY SYSTEM WITH TUBING AND MANIFOLDING FOR AN OFF-AXIS PRINTING SYSTEM

[75] Inventors: Gary L. Miller, Vancouver, Wash.; Ted T. Lee, Escondido, Calif.; Kenneth R. Williams; Bruce A. McFadden, both of Vancouver, Wash.; Norman E. Pawlowski, Jr, Corvallis, Oreg.; Michael K. Bowen, Vancouver, Wash.

[73] Assignee: Hewlett-Packard Company, Palo Alto, Calif.

[21] Appl. No.: 08/706,060

[22] Filed: Aug. 30, 1996

[51] Int. Cl.[7] ..... B41J 2/175

[52] U.S. Cl. ..... 347/85

[58] Field of Search ..... 347/85, 86, 87, 347/37; 346/140.1

[56] References Cited

U.S. PATENT DOCUMENTS

| | | | |
|---|---|---|---|
| 3,102,770 | 9/1963 | McKeegan . | |
| 3,373,435 | 3/1968 | Strong | 346/140.1 |
| 4,356,499 | 10/1982 | Kodama | 347/40 |
| 4,394,669 | 7/1983 | Ozawa et al. | 347/86 |
| 4,475,116 | 10/1984 | Sicking et al. | 347/86 |
| 4,528,576 | 7/1985 | Koumura et al. . | |
| 4,540,996 | 9/1985 | Saito . | |
| 4,672,432 | 6/1987 | Sakurada et al. . | |
| 4,684,962 | 8/1987 | Hirosawa et al. . | |
| 4,775,868 | 10/1988 | Sugiura . | |
| 4,806,956 | 2/1989 | Nishikawa et al. . | |
| 4,831,389 | 5/1989 | Chan . | |
| 4,905,024 | 2/1990 | Nishikawa et al. . | |
| 4,926,196 | 5/1990 | Mizoguchi . | |
| 4,929,963 | 5/1990 | Balazar . | |
| 4,999,652 | 3/1991 | Chan | 347/86 |
| 5,025,270 | 6/1991 | Umezawa . | |
| 5,043,746 | 8/1991 | Abe . | |
| 5,469,201 | 11/1995 | Erickson et al. | 347/85 |

FOREIGN PATENT DOCUMENTS

| | | | |
|---|---|---|---|
| 0 666 178 | 9/1995 | European Pat. Off. | B41J 2/175 |
| 0 699 533 | 6/1996 | European Pat. Off. | B41J 2/175 |
| 55-42858 | 3/1980 | Japan . | |
| 357210879 | 12/1982 | Japan . | |
| 58-51156 | 3/1983 | Japan . | |
| 58-208061 | 5/1983 | Japan . | |
| 358194563 | 11/1983 | Japan . | |
| 60-232964 | 2/1985 | Japan . | |
| 60-264255 | 4/1985 | Japan . | |
| 60-232964 | 7/1985 | Japan . | |
| 360264255 | 12/1985 | Japan . | |
| 61-5950 | 1/1986 | Japan . | |
| 61-27259 | 8/1986 | Japan . | |
| 62-116152 | 1/1987 | Japan . | |
| 62-218136 | 6/1987 | Japan . | |
| 36215288 | 7/1987 | Japan . | |
| 36222034 | 9/1987 | Japan . | |
| 363147651 | 6/1988 | Japan . | |
| 363154354 | 6/1988 | Japan . | |
| 5-169671 | 7/1993 | Japan . | |

OTHER PUBLICATIONS

European Search Report mailed Oct. 20, 1998 regarding European Patent Application No. EP97306158.

*Primary Examiner*—N. Le
*Assistant Examiner*—Michael Nghiem

[57] ABSTRACT

A tube routing configuration for a printing system with an off-axis ink supply system. The system includes a printer housing and a transporting system for transporting a print medium along a medium path to a print area. A scanning carriage holds a printing cartridge with a print-head, the carriage holding the cartridge such that the printhead faces the print zone. A carriage scanning apparatus moves the carriage along a scanning axis transverse to the medium path at the print area. An off-axis ink supply station is mounted in a fixed position relative to the printer housing. Hollow flexible tubing interconnects between the carriage and the off-axis ink supply station to provide an ink replenishment path for the printer cartridge. The tubing is routed between the carriage and the off-axis supply station such that a loop is formed in the tubing, and wherein the loop is substantially contained within a vertically projected volume swept out by the carriage, thereby reducing the need for additional product volume required for the tubing.

25 Claims, 14 Drawing Sheets

FIG. 12
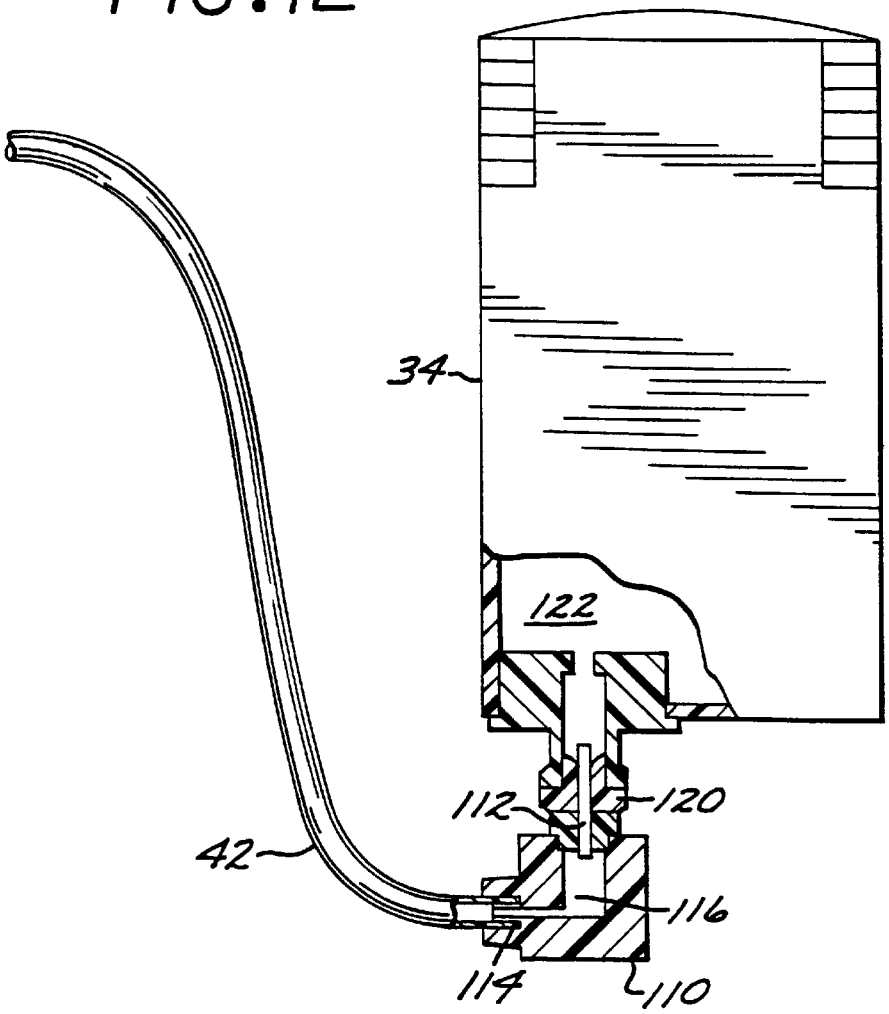
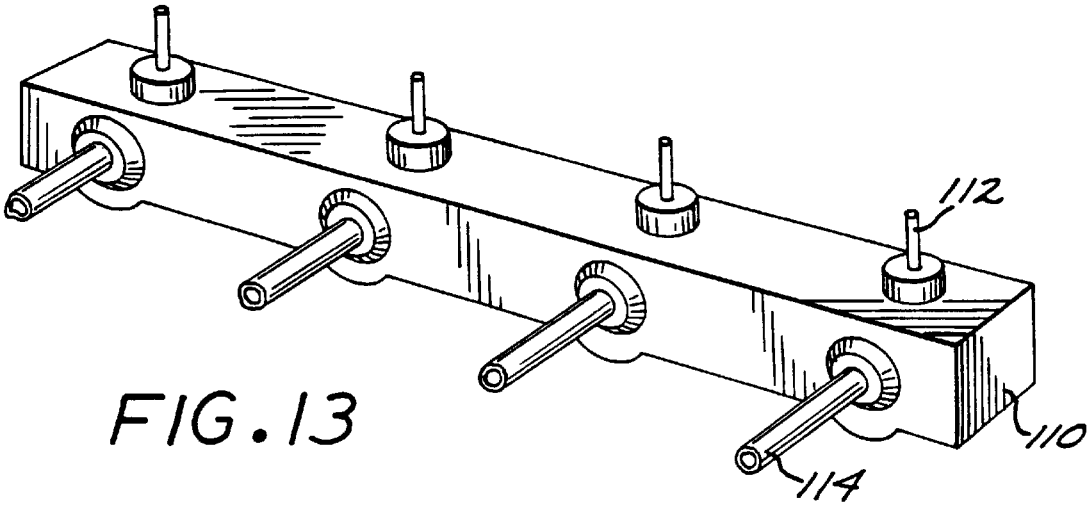
FIG. 13

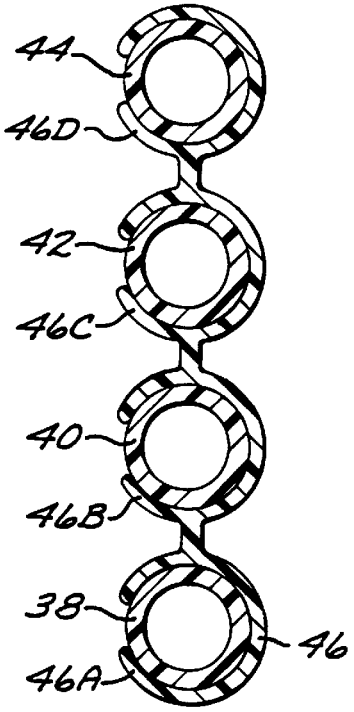
FIG.14
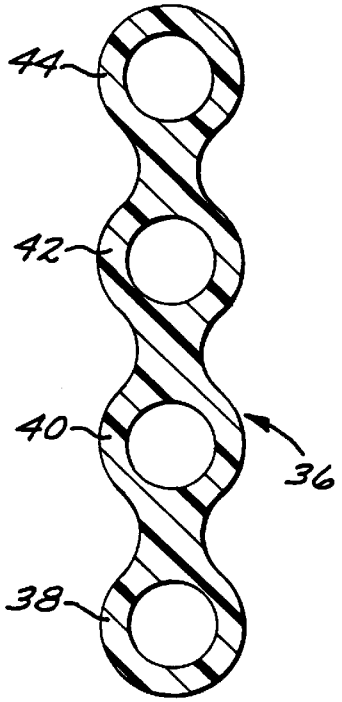
FIG.15
FIG.16
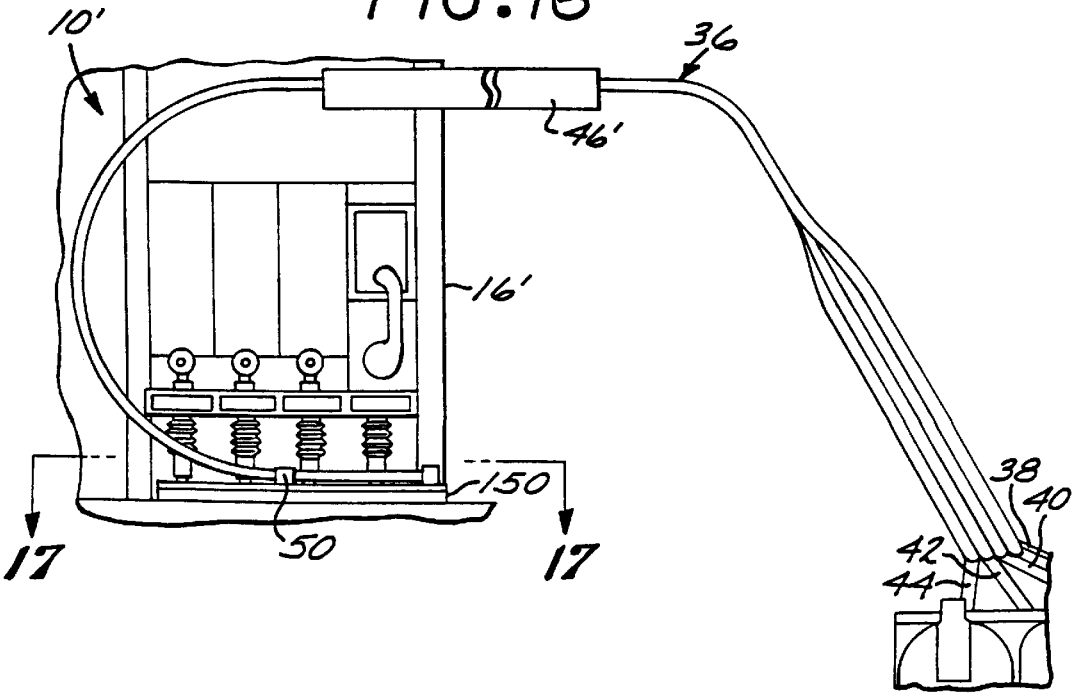

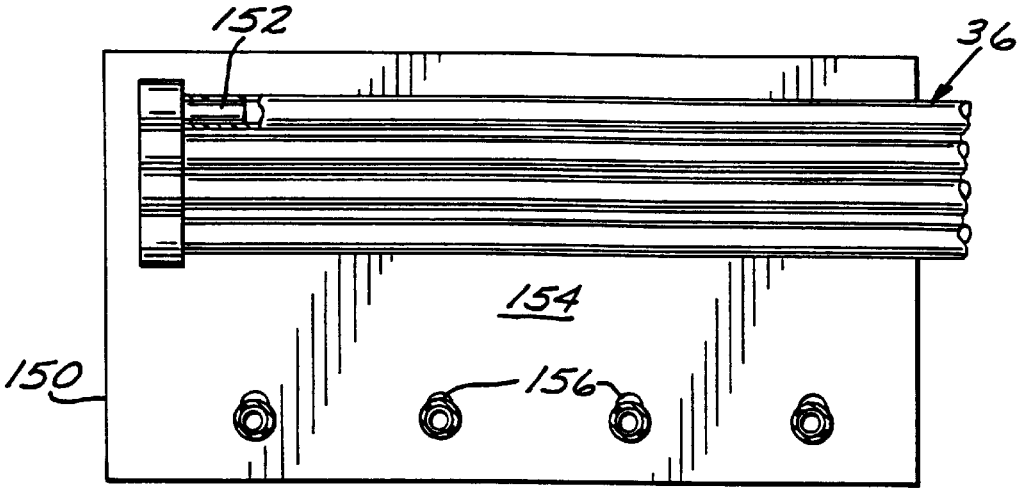
FIG. 17
FIG. 18
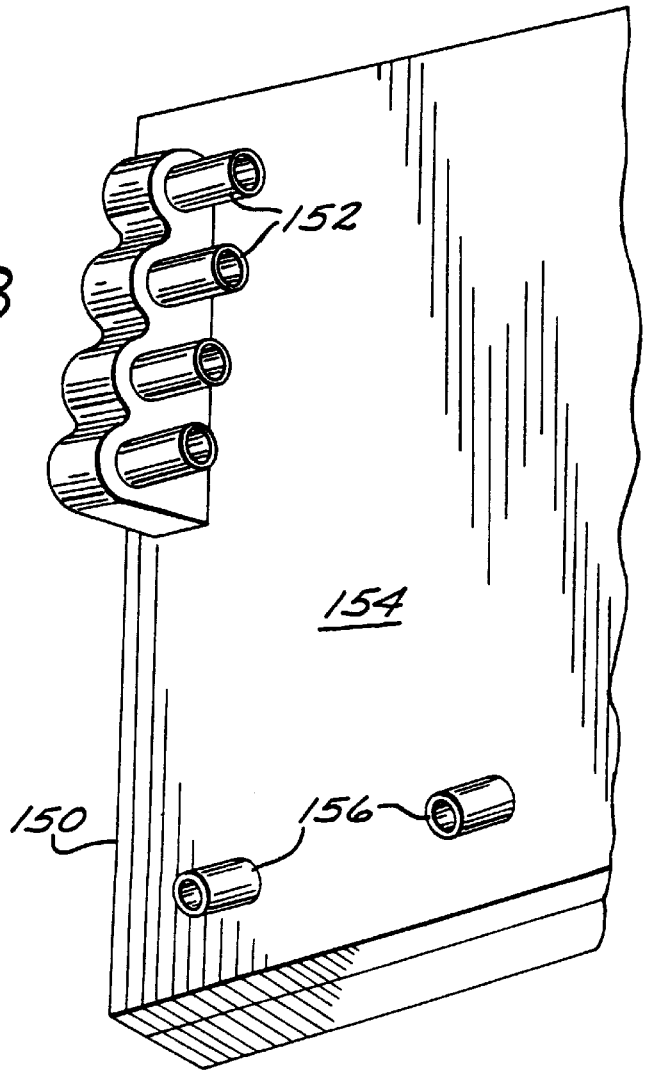

FLUIDIC DELIVERY SYSTEM WITH TUBING AND MANIFOLDING FOR AN OFF-AXIS PRINTING SYSTEM

CROSS-REFERENCE TO RELATED APPLICATIONS

This application is related to commonly assigned applications entitled COMPLIANT INK INTERCONNECT BETWEEN PRINT CARTRIDGE AND CARRIAGE, Ser. No. 08/706,045, now U.S. Pat. No. 5,908,032 filed on Aug. 30, 1996, and INK-JET PRINTING SYSTEM WITH OFF-AXIS INK SUPPLY AND HIGH PERFORMANCE TUBING, Ser. No. 08/706,061, abandoned, filed Aug. 30, 1996, the entire contents of which applications are incorporated herein by this reference.

TECHNICAL FIELD OF THE INVENTION

This invention relates to ink-jet printers, and more particularly to a printing system employing off-axis ink supplies connected to a carriage mounted pen via tubing and manifolding.

BACKGROUND OF THE INVENTION

Ink-jet printers are well known in the art, and many utilize a carriage which carries one or more ink-jet cartridges or pens in a traversing or scanning movement transverse to the printer paper path. It is also known to provide an external stationary ink reservoir connected to the scanning cartridge via a tube. The external reservoir is typically known as an "off-axis" ink reservoir. While providing increased ink capacity, these off-axis systems present a number of problems, however. The space requirements for the off-axis reservoirs and tubing impact the size of the printer, with consequent cost increase. Moreover, pressure drops through the tubing can reduce printer throughput and affect printing quality. Another problem is that of vapor losses from the tubing and air diffusion into the tubing system. In the past, tubing such as LDPE (low density polyethylene) has been used, since it is a low modulus material which is easy to bend. This low modulus material suffers from relatively high vapor losses and air diffusion into the tube. As a result of the vapor losses, the ink can change properties, degrading print quality and eventually causing tube or printhead clogging. As a result of air ingestion, the printhead can fill with air. During thermal fluctuations, the air can expand, causing printhead drool. In addition, the air can cause printhead starvation. Further problems include the force exerted on the carriage by the tubing, and the stresses on the tubing that tends to cause buckling or fatigue failures. These problems are exacerbated with a low end off-axis printing system with its relatively small form factor.

It would therefore be an advantage to provide a compact, low end off-axis printing system.

It would further be advantageous to provide such a printing system which permits high throughput printing, with relatively high flow rates through the tubing.

Still other advantages would be provided by an off-axis printing system with high reliability due to low vapor losses and air diffusion, yet with minimal tubing pressure drops while minimizing the force exerted by the tubing on the carriage to maintain accurate printhead alignment.

SUMMARY OF THE INVENTION

A printing system with an off-axis ink supply system is described, and includes a printer housing and a transporting system for transporting a print medium along a medium path to a print area. A scanning carriage holds a printing cartridge with a printhead, the carriage holding the cartridge such that the printhead faces the print zone. A carriage scanning apparatus moves the carriage along a scanning axis transverse to the medium path at the print area. An off-axis ink supply station is mounted in a fixed position relative to the printer housing. Hollow flexible tubing interconnects between the carriage and the off-axis ink supply station to provide an ink replenishment path for the printer cartridge. The tubing is routed between the carriage and the off-axis supply station such that a loop is formed in the tubing, and wherein the loop is substantially contained within a vertically projected volume swept out by the carriage, thereby reducing the need for additional product volume required for the tubing, beyond the carriage swept volume.

BRIEF DESCRIPTION OF THE DRAWING

These and other features and advantages of the present invention will become more apparent from the following detailed description of an exemplary embodiment thereof, as illustrated in the accompanying drawings, in which:

FIG. 12 is a side cross-sectional view taken along line 12—12 of FIG. 4.

FIG. 13 is an isometric view of an off-axis supply manifold structure comprising the system of FIG. 3.

FIG. 14 is a cross-sectional view of a tubing set of the printing system of FIG. 3, taken along line 14—14 of FIG. 5.

FIG. 15 is a cross-sectional view of an alternate embodiment of a tubing set employed in the printer embodiments of this invention, wherein four tubes are defined in a common extrusion.

FIG. 16 is a simplified top view of an alternate printer embodiment in accordance with the invention.

FIG. 17 is a simplified front view of an alternate carriage manifold embodiment employed in the embodiment of FIG. 16.

FIG. 18 is a simplified partial isometric view of the carriage manifold embodiment of FIG. 17.

DETAILED DESCRIPTION OF THE PREFERRED EMBODIMENT

Overview of the Embodiments

An exemplary application for this invention is in an off-axis ink delivery system for a low end printing system. In the exemplary system, a scanning carriage moves a print head that fires ink drops in a dot matrix pattern onto a paper or other print medium. The print head is in fluid communication with a replaceable ink supply which is releasably mounted in a fixed ink supply station. Objectives of this system include the following:

(1) to provide a compact, low end printing system;

(2) to allow high throughput printing, with high flow rates through the tubing;

(3) to minimize pressure drops through the tubing;

(4) to maintain accurate print head alignment, by minimizing the forces exerted by the tubing on the print head carriage; and (5) to provide high reliability, through very low vapor losses and air diffusion through the tubing.

Figure 1:
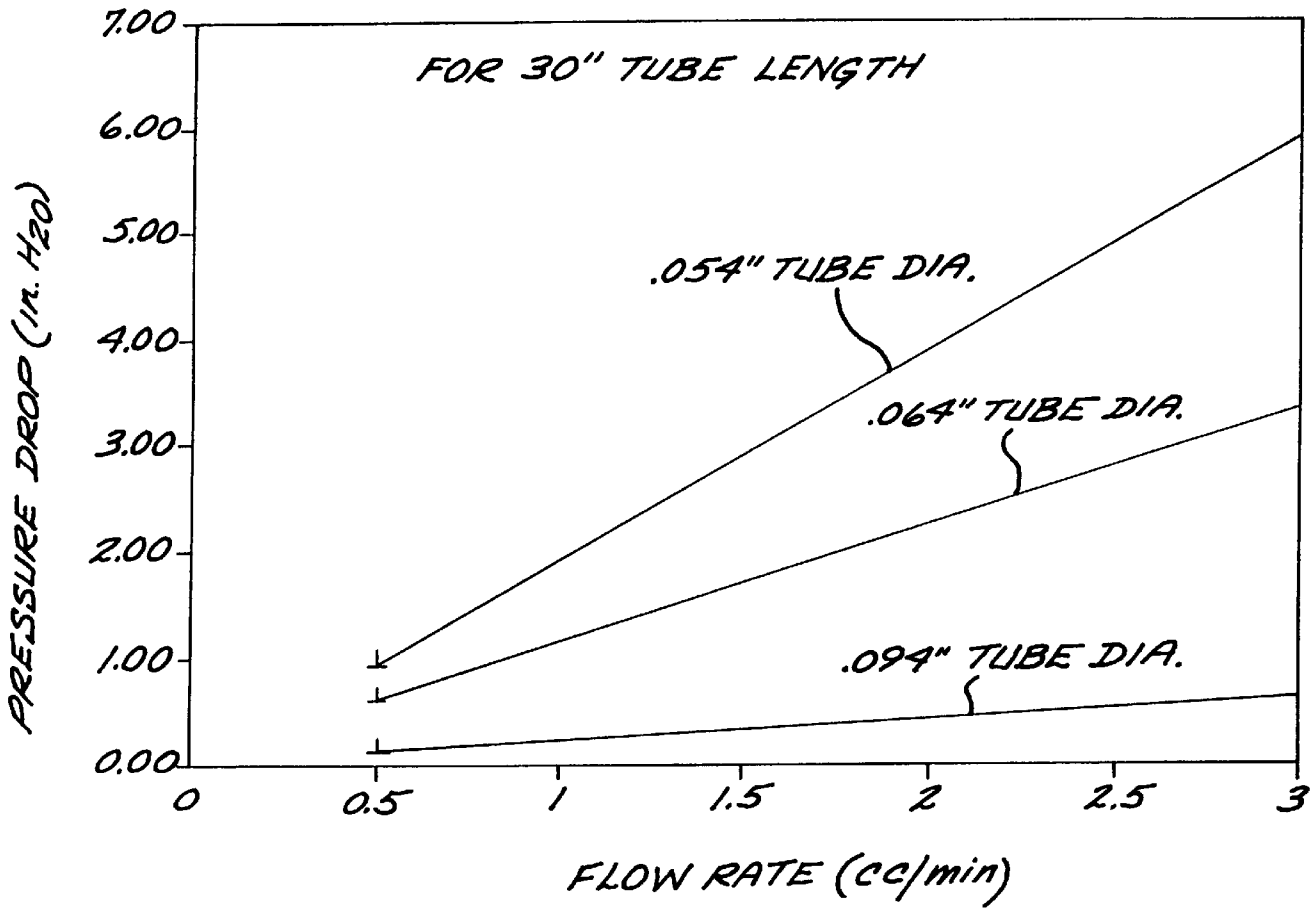
FIG. 1 is a graph showing results of characterization efforts of flow rates as a function of tube diameter for exemplary 3 centipoise ink.

The tubing requirements add to the difficulty of meeting these objectives. In order to minimize pressure drops, tubing with diameters larger than 0.050 inch ID (inner diameter) is desired, with a preferred inner diameter of 0.094 inches ID or larger for minimizing pressure drops. FIG. 1 is a graph showing results of characterization efforts of flow rates as a function of tube diameter for exemplary 3 centipoise ink. Moreover tube fitments become difficult when the diameter is below 0.0625 (1/16) inches. Smaller tubes are desired in order to allow for tube routing, since larger tubes exert more force and tend to kink when bent around tight corners. The requirement for low vapor losses and air diffusion requires tubing materials that have fairly high tensile modulus. For example, polychlorotrifluoroethylene (PCTFE) has a modulus of approximately 300,000 psi, and PCTFE copolymer has a tensile modulus of approximately 160,000 psi.

The effect of larger diameters and high modulus tubing materials has two deleterious effects. First, it sets a low limit on the radius of the tubing, which impacts printer size. Going below a certain bend radius increases the force exerted by the tubing on the carriage, which will adversely affect carriage alignment. In addition, the low bend radius can result in tubing buckling or fatigue failures. This militates toward smaller diameter tubing.

The off-axis ink delivery system in accordance with the invention embodies several aspects. According to one aspect of the invention, manifolding is used to route the ink fluid through ninety degree turns, which are not possible with tubing diameters greater than about 0.0625 inches ID. According to a second aspect of the invention, a stress relief clamp holding the tubing in place on the carriage is located near the slider rod to minimize the impact of the tubing on dot placement and carriage-to-carriage rod frictional forces. According to a third aspect of the invention, the overall tube path allows for the maximum dynamic bend radius during all carriage scan positions. The dynamic bend radius is the radius of the loop that varies as the carriage scans. This minimizes the tube stress loading on the carriage and minimizes the chances of exceeding tube fatigue or buckling limits. Further, the tube dynamic loop is never trapped between the carriage and a fixed wall and thus forced to a very small bend diameter. Instead, the tubing set is above the carriage and, in an exemplary embodiment, is allowed to stay at a 50 mm to 60 mm radius for the full travel of the carriage. A fourth aspect of the invention is the method of manifolding or stress relieving and heat forming to eliminate the tendency of the tube to kink when bent around a 90 or 180 degree bend, particularly important when a tube of diameter that allows for reasonable pressure drops is used and when the material provides high performance in a tubing application.

The tubing used in the ink delivery system should meet several objectives. It should have a very low vapor transmission rate (VTR) and very low air diffusion. The tubing modulus should be minimized to the extent possible while meeting the other objectives to minimize the force exerted on the carriage. The tubing should operate for many cycles of the carriage scanning back and forth, e.g. for millions of cycles for some applications, without failure. Finally, the tubing should be very low cost.

Figure 2:
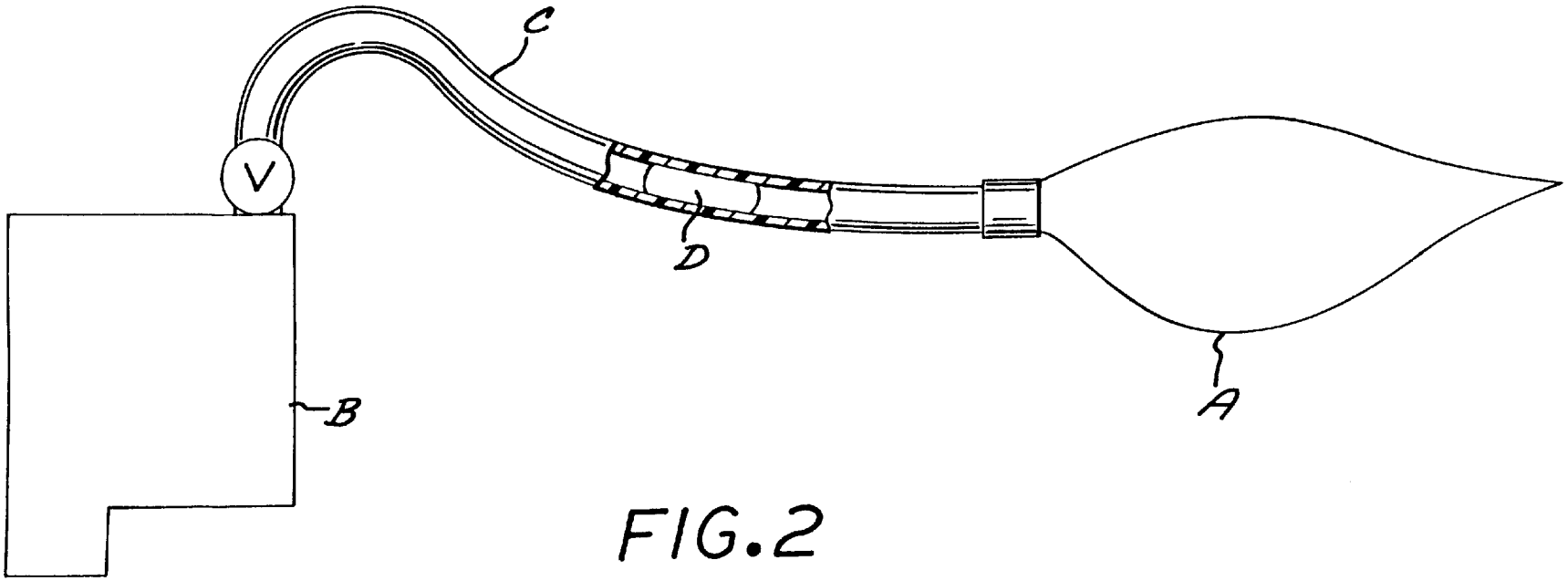
FIG. 2 is a simplified schematic diagram of a printer cartridge connected via a length of tubing to an off-axis ink reservoir represented as a flaccid bag, with an air bubble in the tubing to illustrate an air diffusion problem addressed by an aspect of the invention.

Air diffusion into the tubing is a more difficult problem to eliminate than that of volatiles escaping from the tubing and the ink partially concentrating and even partially drying in the tubing. Air ingestion is the growth of bubbles that are pre-existing in the tubing that is in fluid communication with a flaccid bag. The problem is illustrated in FIG. 2. Consider ink held in a flaccid closed bag A, and connected to a printing cartridge B through a tube C with an air bubble D. The outside atmosphere, the total pressure in the bag, and the bubble total pressure are equalized (assume they are level and static):

$$P_{tot,tube}=P_{tot,bag}=P_{tot,outside}$$

Now, total pressure equals air (primarily oxygen and nitrogen, not counting vapors) pressure plus partial pressure of vapor:

$$P_{tot,tube}=P_{air,tube}+P_{vapor,tube}=P_{air,outside}+P_{vapor,outside}$$

Thus, $$(P_{air,outside}-P_{air,tube})=(P_{vapor,tube}-P_{vapor,outside})$$

Now, the vapor air in the tube is fully saturated; however, the pressure of vapor outside may vary. In Arizona, for example, the vapor pressure may be very low. In Florida, it would typically be very high. In very dry environments, such as Arizona, the diffusion rate of air can be very high. With low performance tubing materials, the tubes can fill with air in a few days. The air in the tubing will be drawn into the print cartridge, causing starvation of the printhead or dysfunction of the regulator.

According to an aspect of the invention, a tubing has been employed in the printing system embodying the invention which meets the above objectives. One presently preferred tubing material suitable for the purpose is Polyvinylidene Chloride copolymer (PVDC). The tubing is manufactured using known extrusion processes for making tubing. The PVDC materials known to be extrudable and exhibit good oxygen and water barrier properties, insofar as presently known, tend to include a ratio of approximately 80% vinylidene chloride monomer and 20% vinyl chloride monomer. There are typically additional standard polymer materials added to this ratio to aid in the extrusion process or provide additional important properties such as flexibility; the addition of such materials is known in the art. PVDC copolymer materials suitable for the purpose are commercially available. For example, Dow Chemical markets materials under the trademark "Saran." Versions of "Saran" that appear to be suitable for the purpose include "Saran 2032," "Saran 32056," and "Saran 313," all trademarks of Dow Chemical.

Other materials known to applicants which can be used for the tubing application include PCTFE copolymer and ECTFE (ethylenechlorotrifluoroethylene). These materials have exemplary characteristic values given in Table I below, with a water vapor transmission rate (WVTR) (gram-mil/100 inches$^2$-Day) at 10% relative humidity (RH), 100° F.; $O_2$ permeability (cc·mil/(100 in$^2$·day·atm), 23° C., 0% RH); tensile modulus (psi), where psi represents pounds per square inch. The foregoing units of measure are well known in the art. Moreover, these materials exhibit good fatigue and chemical resistance, and are relatively low cost.

TABLE I

| Property | ECTFE | PCTFE copolymer | PVDC |
|---|---|---|---|
| WVTR | 0.45 | 0.027 | 0.25 |
| $O_2$ Perm. | 20 | 12 | 2.5 |
| Tensile mod | 240,000 | 160,000 | 65,000 |

While in a preferred embodiment, the tubing is formed as an extrusion consisting of the selected low diffusion material, the tubing can alternatively be formed as a multi-layered tube, wherein the tubing is fabricated of a layer of very flexible polymer material, and another layer of PVDC copolymer or other low diffusion material.

Exemplary Printing System Embodiments

Figure 3:
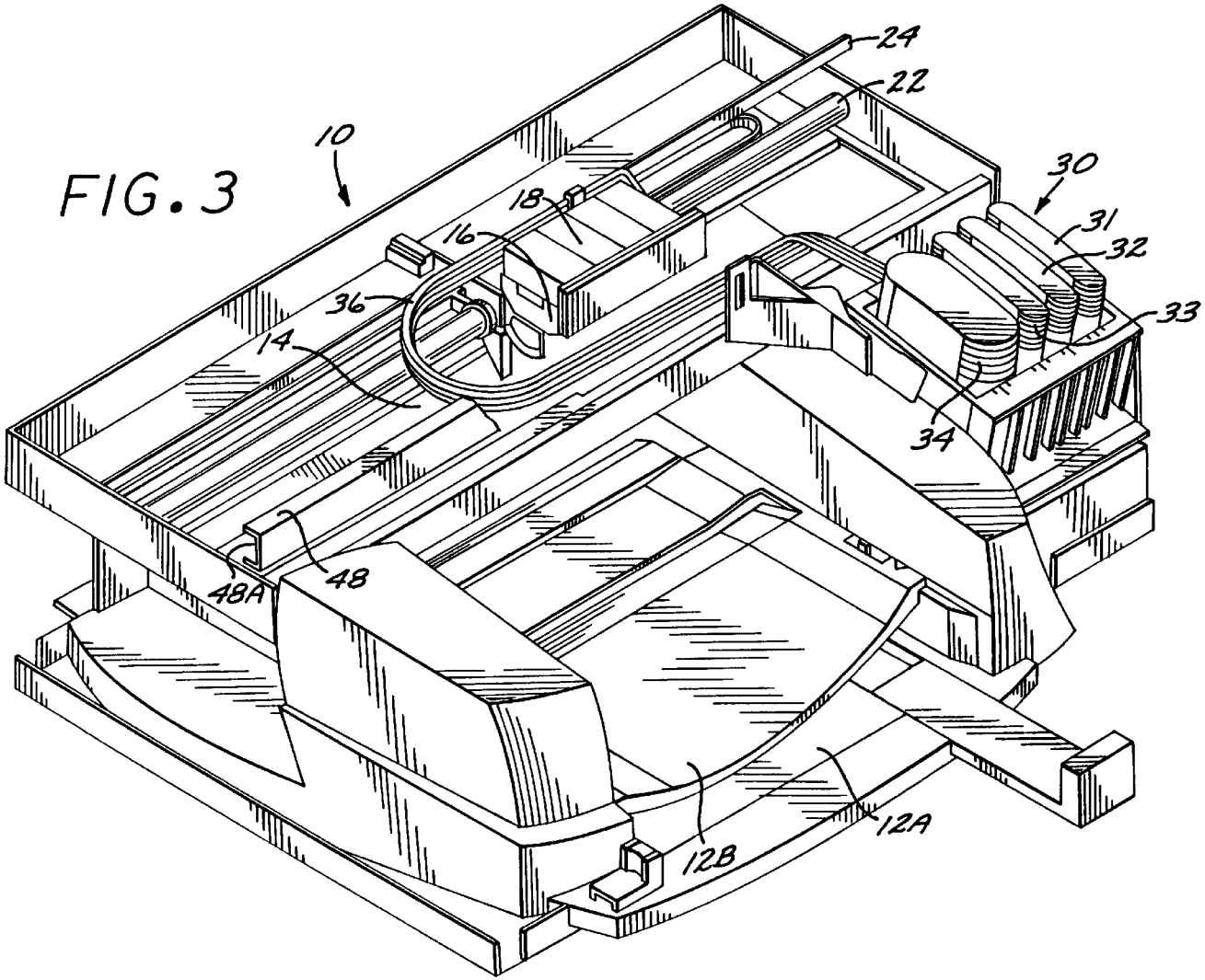
FIG. 3 is a perspective view of a color ink-jet printer embodying the invention, with its cover removed.

Turning now to FIG. 3, a perspective view is shown of an exemplary embodiment of an ink-jet printer embodying the invention, with its cover removed. Generally the printer 10 includes a tray 12A for holding an input supply of paper or other print media. When a printing operation is initiated, a sheet of paper is fed into the printer using a sheet feeder, and then brought around in a U direction to travel in the opposite direction toward output tray 12B. The sheet is stopped in a print zone 14, and a scanning carriage 16, containing one or more print cartridges 18, is then scanned across the sheet for printing a swath of ink thereon. After a single scan or multiple scans, the sheet is then incrementally shifted using a stepper motor and feed rollers (not shown in FIG. 3) to a next position within the print zone 14, and carriage 16 again scans across the sheet for printing a next swath of ink. When printing on the sheet is complete, the sheet is forwarded to a position above the tray 12B, held in that position to ensure the ink is dry, and then released.

Alternate embodiments of the printer include those with an output tray located at the back of the printer 10, where the sheet of paper is fed through the print zone 14 without being fed back in a U direction.

The carriage 16 scanning mechanism may be conventional, and generally includes a slide rod 22, along which carriage 16 slides, and a coded strip 24 which is optically detected by a photodetector in carriage 16 for precisely positioning carriage 16. A stepper motor (not shown), connected to carriage 16 using a conventional drive belt and pulley arrangement, is used for transporting carriage 16 across print zone 14.

Novel features of the ink-jet printer 10 relate to the ink delivery system for delivering ink to the print cartridges 18 from an off-axis ink supply station 30 containing replaceable ink supply cartridges 31, 32, 33 and 34. For color printers, there will typically be a separate ink supply station for black ink, yellow ink, magenta ink, and cyan ink. Since black ink tends to be depleted most rapidly, the black ink supply 34 has a larger capacity than the capacities of the other ink supplies 31–33.

A tubing set 36 of four tubes 38, 40, 42 and 44 carry ink from the four off-axis ink supply cartridges 31–34 to the four print cartridges 18. In accordance with one aspect of the invention, the tubes 38–44 are formed of a PVDC copolymer. Other materials are also suitable for the purpose, including ECTFE, such as Halar™, and PCTFE copolymer, such as Aclon 3000™. Such tubing materials provide the necessary barrier to air diffusion, and meet the other criteria discussed above for the tubing.

Figure 4:
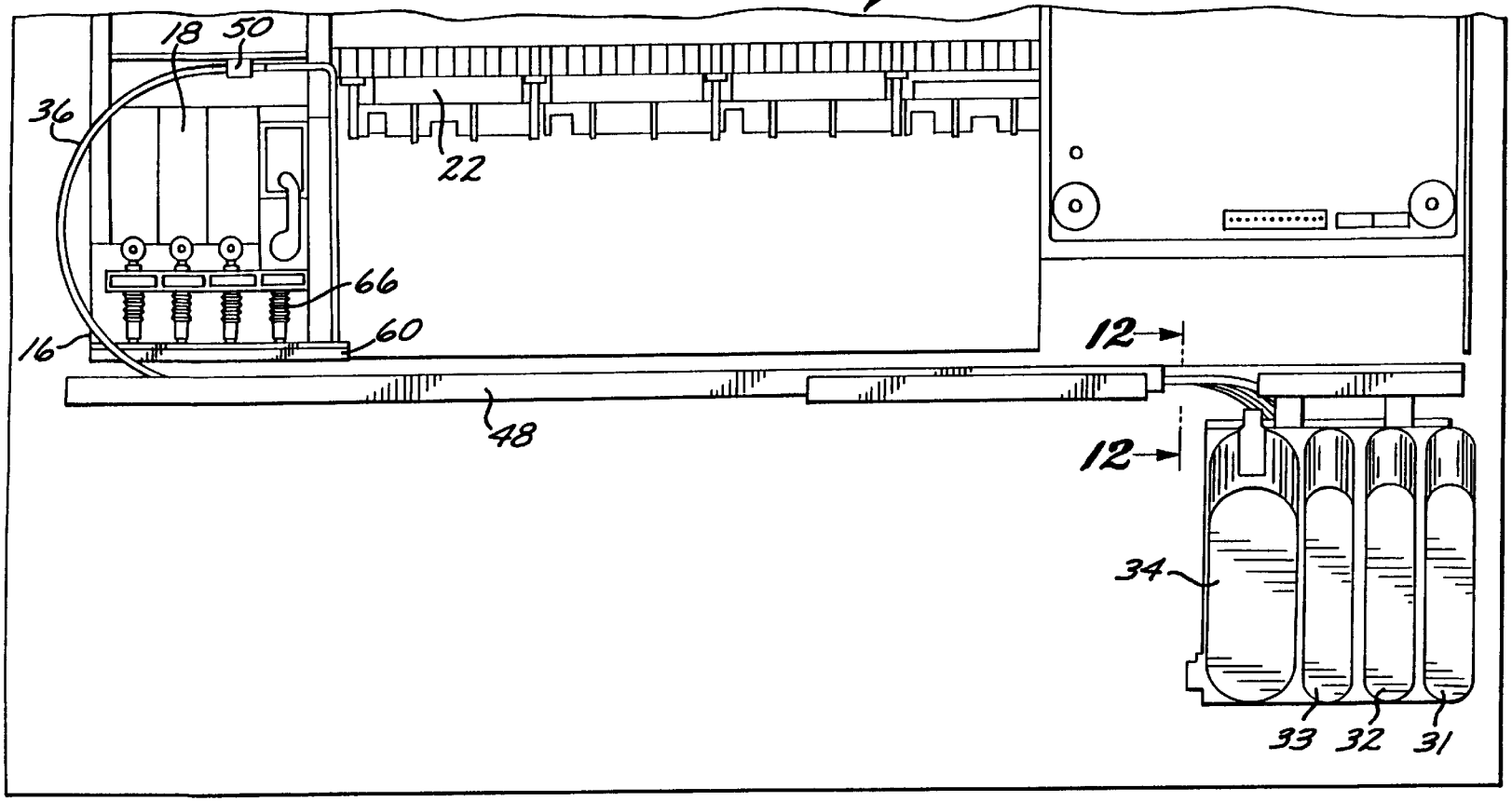
FIG. 4 is a simplified, partial top view of the printer of FIG. 3, showing a routing of the ink supply tubes from the off-axis ink reservoirs to the carriage-mounted ink cartridges.

FIG. 4 is a top view of the printer 10 of FIG. 3. This shows the tube routing of the tubing set 36 according to a further aspect of the invention. The tube routing is designed to accommodate the tubing set while minimizing the space needed for the tubing set 36 to follow the carriage 16 along its scanning path. In this exemplary embodiment, the tubes 38–44 are secured together in a flat ribbon intermediate the tube ends. This can be achieved by a flexible tubing carrier 46, fabricated of a flexible plastic material with tube-receiving channels 46A–46D formed therein, sized so that the individual tubes snap fit into the channels, as shown in FIG. 14. An exemplary material for fabrication of the tube carrier is polyurethane. Alternatively, the four tubes 38–44 can be fabricated of an integral extrusion 36', wherein the tubes are joined together by portions of the extrusion. This alternate embodiment is shown in FIG. 15.

The tubing set 36 runs from the individual off-axis cartridges 31–34 to the carriage mounted cartridges 18 in a run length of approximately 25 to 30 inches for a small printer, with about 26–28 inches in the exemplary embodiment. The inner tube diameter is in the range of 0.030 to 0.150 inches, depending on the required ink flow rates, with 0.054 to 0.094 inches the preferred range, and about 0.064 inches an exemplary preferred diameter of the tubing for the printer 10. The tubing outer wall thickness is preferably in the range of 0.010 inch to 0.020 inch, with a preferred value of 0.015 inches. The tubing bend stress versus air diffusion requirements tends to define this value.

The tubing set 36 runs in a C-shaped channel guide 48 which is open along a side facing the print zone 14. A clamp (not shown) located at the off-axis supply end of the channel guide secures the position of the tubing set 36 relative to this end of the guide. The channel guide 48 constrains the tubing set 36 such that it cannot move further away from the print zone 14 than the upright wall 48A of the member 48, yet permits the tubing set 36 to move out of the channel guide as needed to follow the movement of the carriage 16.

Figure 5:
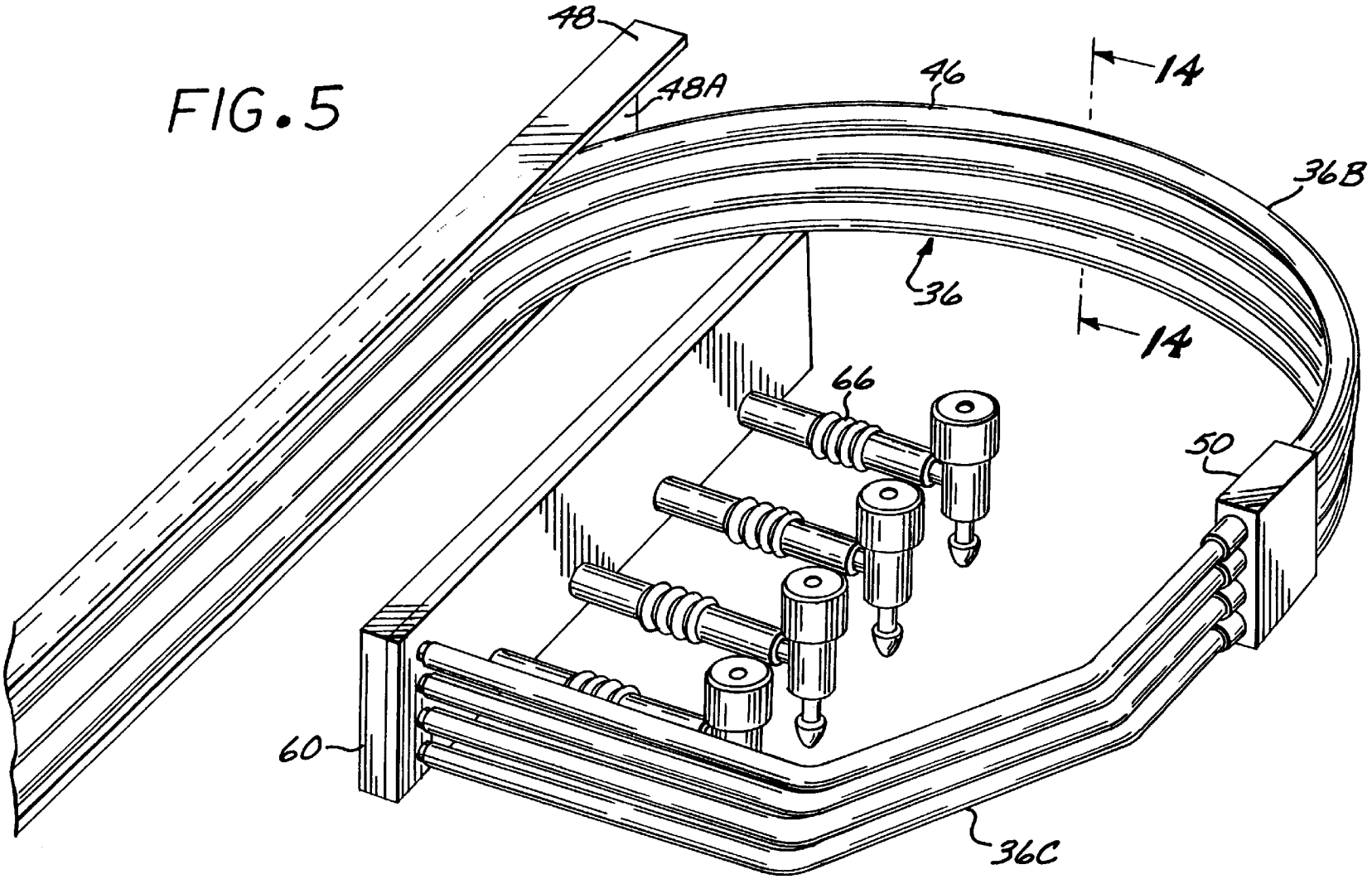
FIG. 5 is an isometric view of the carriage manifold and the connection to the tubing set.
Figure 6:
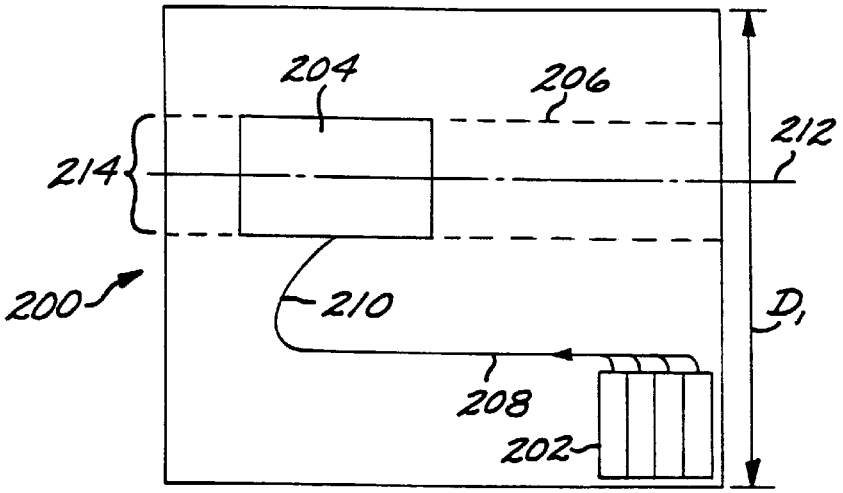
FIG. 6 is a simplified top view of a printer with an off-axis ink supply station and a scanning carriage.
Figure 7:
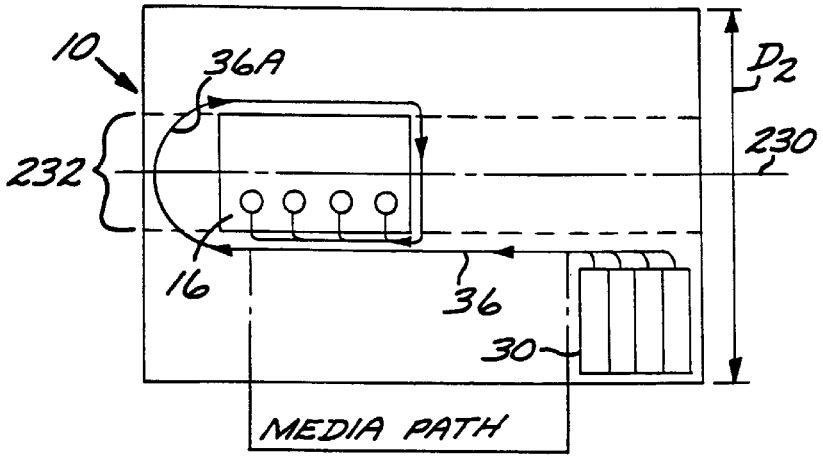
FIG. 7 shows a highly simplified top view of the printer of FIG. 3, illustrating the carriage, the vertical plane passing through the nozzle arrays of the printheads carried on the carriage, the off-axis ink supply station and tubing set.

The tubing set 36 is clamped upright to the carriage 16 by a stress relief clamp 50, and so the tubing set 36 includes an off-carriage portion 36B and an on-carriage portion 36C, divided by the clamp 50. The tube carrier 46 terminates at the stress relief clamp. The tubing set 36 is bent upwardly in this exemplary embodiment from the level of the carriage 16 to the level of the channel member 48. This upward curve is accomplished by bending the tubes 38–44 to make the transition from a horizontal plane at carriage level to an upper horizontal plane at the channel guide 48. Downstream of the clamp 50, the ends of the tubes 38–44 are respectfully connected to input ports of a plastic manifold 60, which routes the ink through corresponding channels to manifold output ports, including port 62A shown in FIG. 9. The manifold output ports are in turn then fluidically coupled to the corresponding print cartridges 18 via ink couplers 66 and needle/septum arrangements, as shown in FIG. 5, and more particularly described in the co-pending application, "COMPLIANT INK INTERCONNECT BETWEEN PRINT CARTRIDGE AND CARRIAGE," Ser. No. 08/706,045 now U.S. Pat. No. 5,980,032. An important tube routing feature embodied in the printer 10 is that the tube set 36 is routed between the off-axis ink supply and the print cartridges on the carriage 16 such that a loop is formed in the tubing set, and wherein a projection of the loop substantially overlaps a corresponding projection of the carriage. It can also be said that, for many applications, the loop is substantially contained within a vertically projected volume swept out by the carriage as it scans through its path of travel. This routing permits a reduction in the depth of the depth size of the printer. This feature is shown in FIG. 6 and FIG. 7. FIG. 6 illustrates a simplified top view of a printer 200 with an off-axis ink supply station 202 and a scanning carriage 204. The vertical projection of the carriage scan swept volume is indicated as 214. A vertical plane 212 bisects the printhead nozzle arrays on the carriage 204, and is parallel to the scan axis of the carriage. The tubing 208 provides a fluid path from the off-axis ink supply station 202 and the carriage 204, with a loop 210 formed in the tubing. It is noted that the tubing does not cross the vertical plane 212 between the off-axis ink supply and the carriage, and the dynamic loop 210 formed by the tubing lies mostly outside of the vertical projection of the carriage scan swept volume. Thus, the tubing takes up additional product volume beyond the carriage swept volume. The printer has a depth indicated at $D_1$. To reduce the volume necessary to accommodate the loop, a low performance tubing material is generally used, such as LDPE tubing, which has a relatively low modulus and thus permits loops with very small bend radii, say on the order of 20 mm. The low performance tubing can permit high air ingestion rates, leading to printing difficulties.

Now consider FIG. 7, which shows a highly simplified top view of the printer 10, illustrating the carriage 16, the vertical plane indicated as numeral 230 passing through the nozzle arrays of the printheads carried on the carriage, the off-axis ink supply station 30 and tubing set 36. A loop 36A is formed in the tubing set. The loop 36A is larger than the loop 210 formed in the tubing 208 of FIG. 6. Yet in spite of the larger loop, say on the order of 50–60 mm, the net increase in printer space due to the larger loop is negligible. This is because the vertical projection of the loop 36A along the media path direction is substantially contained with the vertical projection of the carriage scan swept volume, indicated as 232. In fact the tubing 36 crosses the axis 230 twice in this exemplary embodiment. This is also true for a vertical plane parallel to the scan direction and that goes through the carriage center of mass; plane 230 can also represent such a plane through the center of mass. The vertical projection of the dynamic loop 36A formed in the tubing set 36 will lie substantially within the vertical projection of the swept volume of the carriage as it passes between its right and left limits of travel. (It is the vertical projection of the loop because the loop must stay out of the way of the carriage.) As a result, the depth $D_2$ of the printer 10 can be reduced in comparison to the depth $D_1$ of the printer shown in FIG. 6. In other words, the tube routing configuration of FIG. 7 is space saving because the loop does not add to the depth (measured along the media advance axis) of the printer, even though the loop has a fairly large radius.

Figure 8:
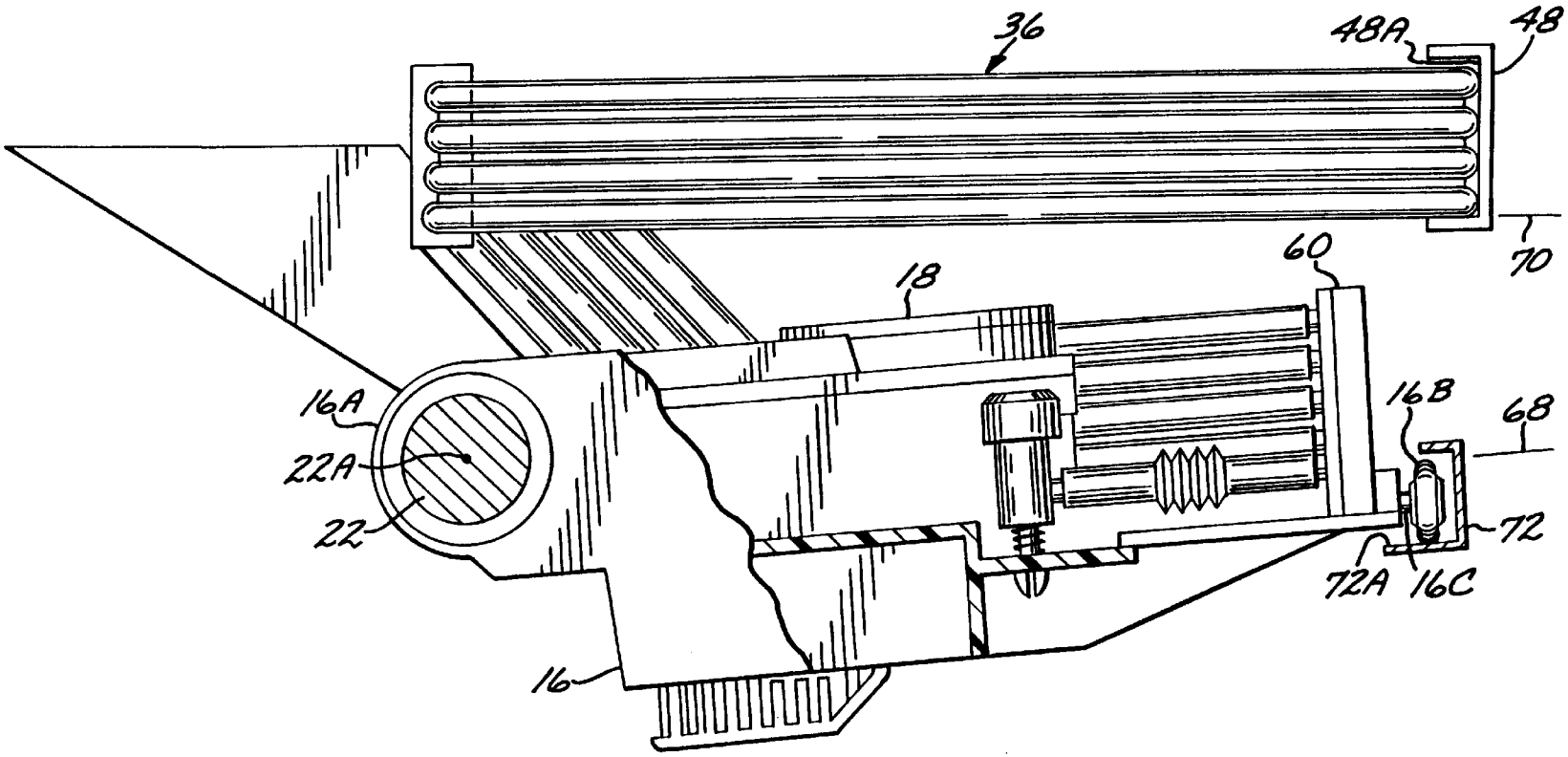
FIG. 8 is a partially broken-away side view of the carriage, slider rod and tubing set of the printer of FIG. 3 in isolation.

FIG. 8 is a partially broken-away side view of a portion of the printer of FIG. 3, showing the slider rod 22, the carriage 16 with print cartridges, the tubing set 36, and the tubing guide. FIG. 8 shows the change in plane of the tubing routing from the carriage plane to a higher plane. The change in plane facilitates a narrow form factor for applications which are sensitive to printer depth. The change in plane also allows placement of the supplies above the carriage which helps throughput by providing extra pressurization on the ink delivery system. It is noted that the carriage 16 is not strictly horizontal, but is slightly tilted from the horizontal as shown in FIG. 8. The position of the rear side of the carriage relative to the rod axis 22A is constrained by the slider rod 22, which is received within a rod receiving structure 16A comprising the carriage 16. The position of the front side of the carriage is determined by an idler wheel 16B which rotates freely on a shaft 16C. Gravity urges the wheel 16C against a lower surface 72A of a guide 72 fixedly attached to the printer housing structure. It is possible for the carriage to rotate to a small degree about the rod 22, against the force of gravity. This can happen if the carriage is subjected to forces urging the front side of the carriage upwardly. Such rotation of the carriage would adversely affect the print quality, since the alignment of the printhead relative to the print media would be affected. It is an object of this invention to minimize the forces applied to the carriage by the tubing set which could tend to lift the wheel off the surface 72A, while at the same time minimizing the size of the printer. This is accomplished by the routing of the tubing set, the selection of the tubing material and diameter and thickness of the tubes.

Figure 9:
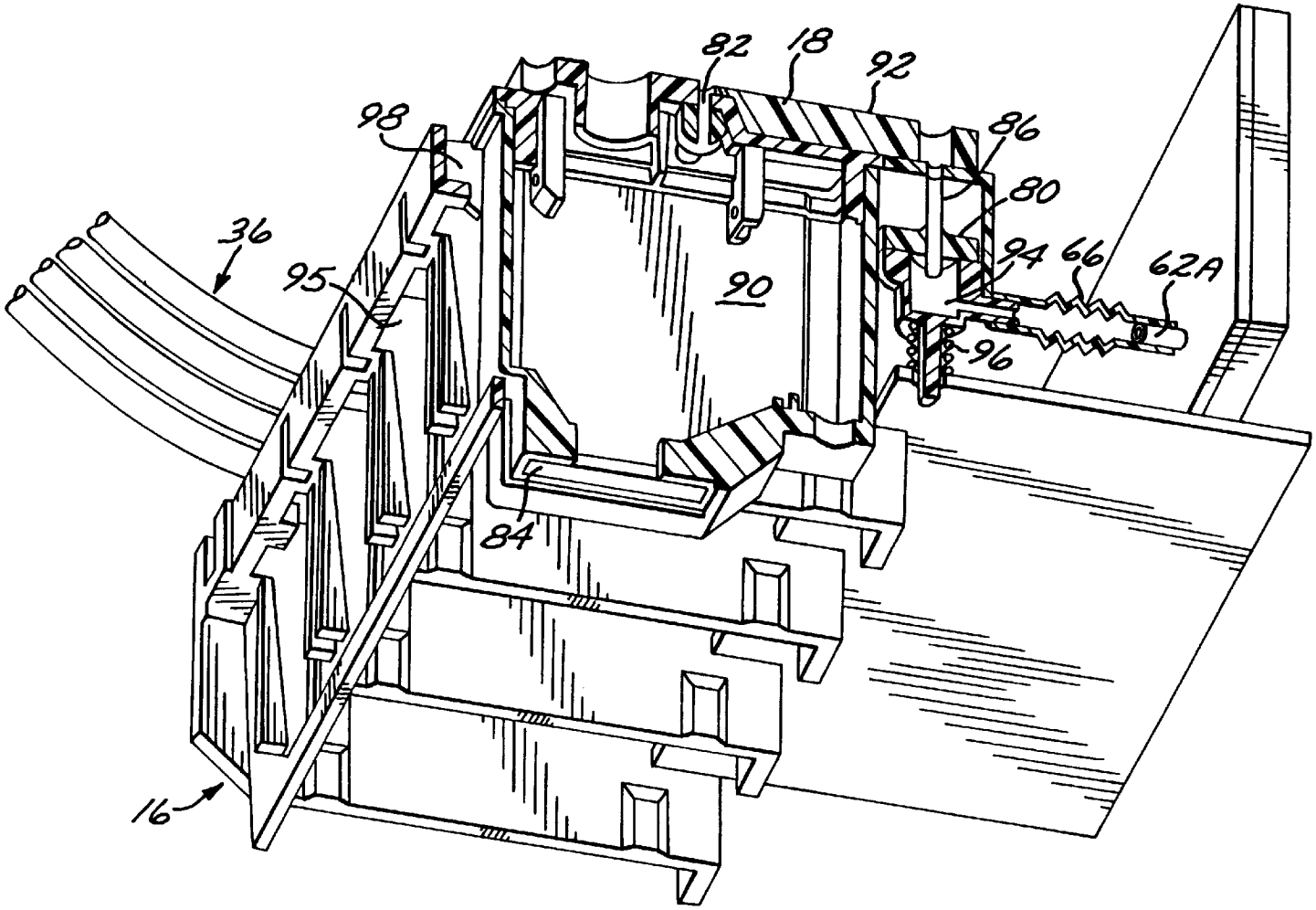
FIG. 9 is an isometric, partially broken-away view of the carriage with printer cartridges comprising the printer of FIG. 3.

FIG. 9 is an isometric view looking up at the carriage 16, showing a print cartridge 18 and septum 80 in cross-section. Not shown in this cross-section is a regulator valve within the print cartridge which regulates the pressure by opening and closing hole 82. An opening in the bottom of the carriage 16 exposes the printhead location 84 of each print cartridge 18. Carriage electrodes (not shown) oppose contact pads on the print cartridge 18. When the regulator valve is opened, a hollow needle 86 is in fluid communication with an ink chamber 90 internal to the cartridge 18. The needle 86 extends through a self-sealing slit formed in through the center of the septum 80. The slit is automatically sealed by the resiliency of the rubber septum 80 when the needle is removed. A plastic conduit 92 leads from the needle 86 to chamber 90 via hole 82. The conduit may also be integral to the print cartridge body. The conduit may be glued, heat-staked, ultrasonically welded or otherwise secured to the print cartridge body. A septum elbow 94 routes ink from the manifold 60 to the septum 80, and supports the septum. The septum is affixed to the elbow using a crimp cap. The coupler 66 in this exemplary embodiment is a flexible bellows for allowing a degree of x, y and z movement of the septum 80 when the needle 86 is inserted into the septum to minimize the load on the needle and ensure a fluid-tight and air-tight seal around the needle. The bellows may be formed of butyl rubber, high acn nitrile or other flexible material having low vapor and air transmission properties. Alternatively, the bellows can be replaced with a U-shaped or circular flexible tube. A spring 96 urges the septum 80 upwardly, allowing the septum to take up z tolerances, minimizes the load on the needle and ensures a tight seal around the needle 60. Slots 98 formed on each of the stalls 95 in the carriage 16 align with tabs on each print cartridge 18 to restrict movement of the print cartridge 18 within the stall.

Figure 10:
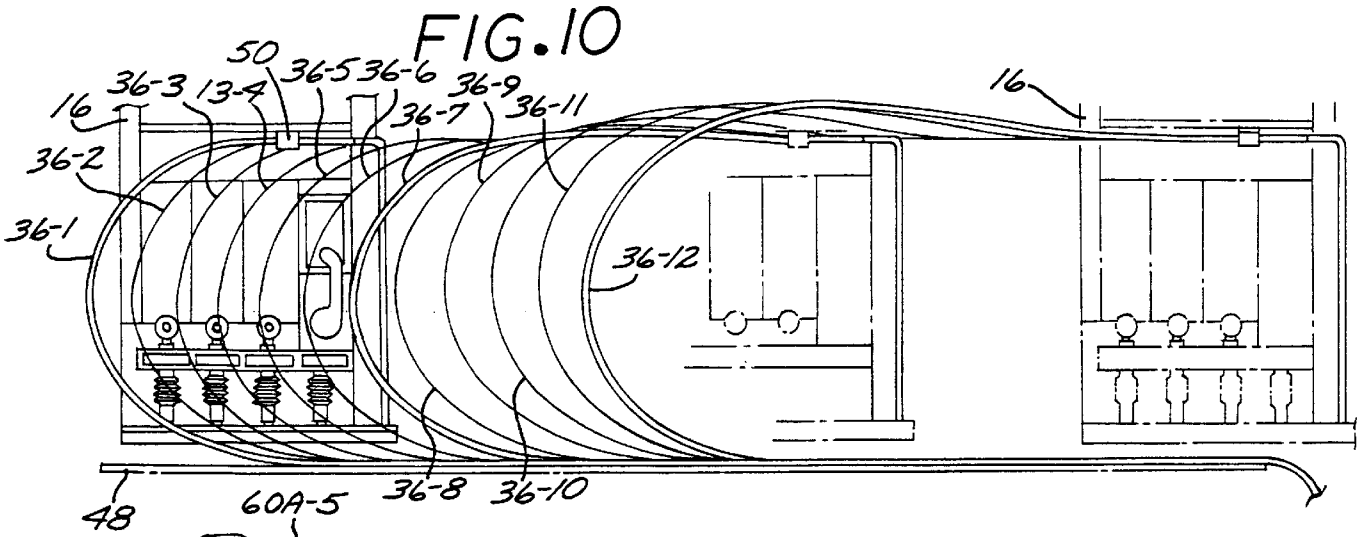
FIG. 10 is a simplified, partial top view of the printer of FIG. 3, showing the position of the tubing set at various carriage positions in its scanning range of motion.

FIG. 10 is a simplified, partial top view of the printer of FIG. 3, showing the position of the tubing set 36 at various carriage positions in its scanning range of motion. At a first carriage position disposed at a first end of the scanning range of motion located away from the off-axis ink supply station 30, the tubing set 36 has the position illustrated as 36-1 in FIG. 10. As the carriage 16 is scanned from the first end of the scanning region to the second end of the scanning region, the tubing set assumes a continuum of positions including the exemplary discrete positions 36-2 through 36-12 shown in FIG. 8. The outer (i.e. away from the area scanned by carriage 16) travel limit of the tubing set 36 is bounded by the channel guide 46 on one longitudinal side of the area scanned by the carriage 16. The outer travel of the tubing set 36 on the opposite longitudinal side of the scanned area is constrained by the stress relief clamp 50 which, at tubing position 36-1, results in the vertical projection of the tubing set 36 substantially containing the carriage 16, yet without the tubing extending past the side of the carriage over the slider rod 22. As the carriage is scanned toward the opposite end of its travel, additional length of the tubing set 36 becomes available to form a somewhat larger loop which does slightly protrude over the side of the carriage over the rod 22, as shown at carriage position 36-12, for example. The printer volume required to accommodate the tubing set is minimized due to the efficient tube routing scheme shown in FIG. 10.

Figure 11:
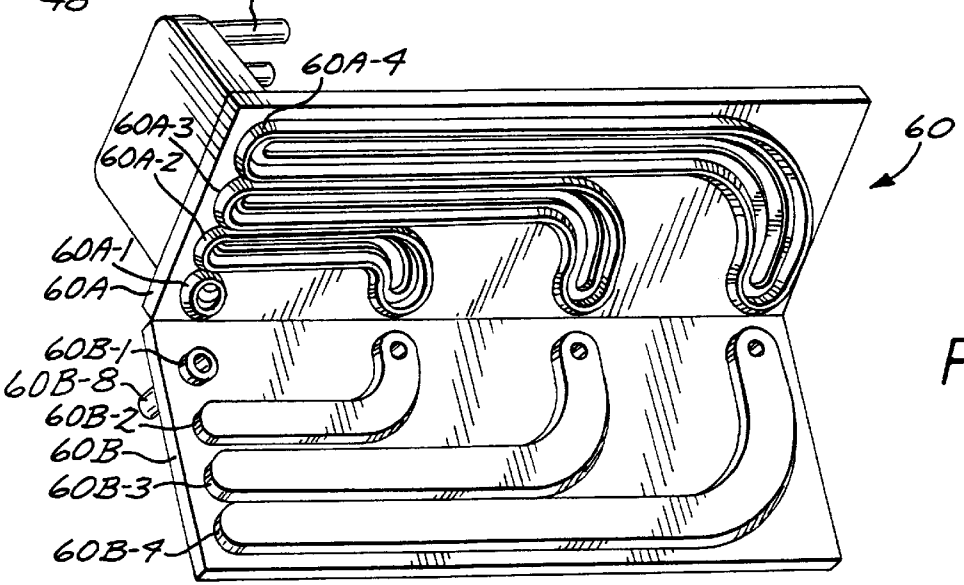
FIG. 11 is an isometric, exploded view illustrating the carriage manifold employed in the printer of FIG. 3.

FIG. 11 is an exploded view of the carriage manifold 60 of the system of FIG. 3. In this embodiment, the manifold is shown to comprise two matching plastic manifold parts 60A and 60B with corresponding channel-defining structures, which when joined together define four leak-resistant fluid channels between an input port connected to a corresponding tube, and an output port connected to a fluid coupler for connection to the corresponding printing cartridge mounted in the carriage. One input port is shown as a short connector tube 60A-5. One output port is shown as short connector tube 60B-8. The two parts of the manifold are joined together with ultrasonic welding, adhesive or other sealing techniques to ensure a lead-resistant joinder between the two parts. Ultrasonic welding is a preferred method of assembly of the manifold, using tongue and groove joints as illustrated. An exemplary material from which the manifold can be constructed is DOW Isoplast 302, a polyurethane.

FIGS. 12 and 13 illustrate an exemplary technique for achieving a fluidic connection between an exemplary off-axis ink cartridge 34 and its corresponding tube 42. A hollow needle 112 extends from an off-axis manifold 110 at a stall in the off-axis supply station 30, and is connected to input port 114 of the manifold via a 90 degree conduit 116 defined in the manifold. The ink within the off-axis cartridges 31–34 is at atmospheric pressure in this exemplary embodiment, and ink is drawn into each of the print cartridges 18 by a negative pressure within each cartridge 18 determined by a regulator internal to each print cartridge. The hollow needle 112 extends in an upward direction from the ink supply support provided by the manifold 110, and is inserted through a rubber septum 120 on the ink supply cartridge 34 to create a fluid communication path between the ink reservoir 122 within the cartridge 34 and the ink conduit 116. In one embodiment, the ink reservoir 122 comprises a collapsible ink bag. The off-axis manifold 110 includes input ports, upwardly extending hollow needles and internal 90 degree fluid conduits for each of the other supply cartridges 31–33 at the supply station 30, as generally indicated in FIG. 13.

It is noted that, for the printer of FIG. 3, a fluid conduit is established between the printer cartridges on the carriage and the off-axis ink supply reservoirs. Depending on the particular implementation, the fluid conduit can include the fluid outlet from the off-axis reservoir, the manifolds at the carriage and off-axis ink supply, the tubing, the fluid coupler between the carriage manifold and the cartridge reservoir. In general, the fluid conduit includes the entire fluid path between the off-axis reservoir and the carriage mounted cartridge.

FIG. 16 is a top view of an alternate printing system embodiment 10', wherein the channel guide 46' is mounted on the opposite side of the print zone from the location of the guide 46 of the printer embodiment of FIG. 4. Thus, the channel guide 46' is mounted adjacent to and above the slider rod 22. The carriage end of the tubing set 36 is connected to the carriage manifold 150, located on the carriage side opposite the channel guide 46'. A stress relief clamp 50' is mounted to the carriage 16' to fix a section of the tubing set 36 to the carriage, as shown in FIG. 16. A disadvantage of the embodiment 10' is that the stress relief clamp 50' is not located adjacent the slider rod 22. Any forces exerted by the tubing set 36 as the carriage is scanned will more readily be transferred into forces tending to pull the idler wheel 16B off the guide surface of guide 72, thus adversely affecting alignment of the printing cartridges relative to a print medium. However, the tube routing of the tubing set 36 is quite efficient, thus minimizing printing system size.

FIGS. 17 and 18 show the alternate form of manifold 150 in further detail. The manifold 150 includes a 90 degree elbow turn on each of the inlet ports 152, so that the tubing set 36 essentially runs parallel to the face of the manifold, instead of meeting the manifold transversely relative to the face of the manifold, as in the embodiment of FIG. 3. Moreover, the distance of each inlet port from the face 154 of the manifold is staggered, thereby facilitating the turning and changing of elevation of the tubing set 36 as it is routed from the carriage to the off-axis ink supply station. In an exemplary embodiment, the fitment stagger of the manifold defines a 15 degree angle, with 4.5 mm spacing between fitments (manifold output ports). There are a plurality of manifold output ports 156, which are coupled to the print cartridges on the carriage via fluid couplers (not shown). The manifold 150 has four internal fluid conduits providing a fluid path from each inlet port to a corresponding output port. The manifold 150 provides essentially three 90 degree changes of direction of the ink path. The manifold 150 can be fabricated of two elements which are fixed together, in a similar fashion as the construction of manifold 60.

Figure 19:
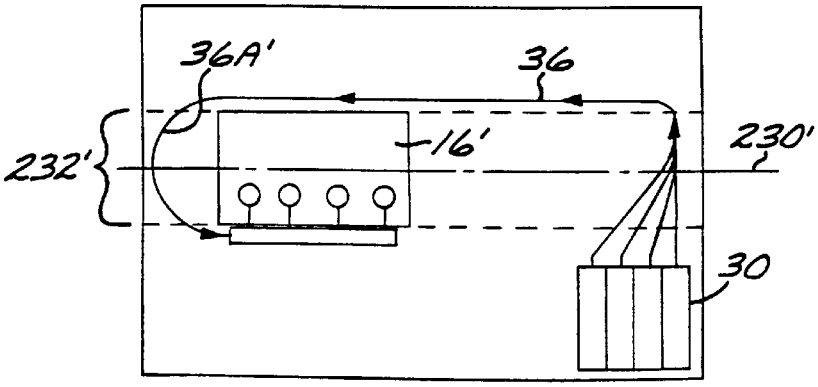
FIG. 19 is a highly simplified top view of the printer embodiment of FIG. 16, corresponding to FIG. 7.

FIG. 19 is a simplified top view of the printer 10' of FIG. 16, and corresponds to FIG. 7. Here again, the vertical projection of the dynamic loop 36A' will be substantially contained within the vertical projection of the carriage swept volume 232', and crosses the vertical plane 230'.

Figure 21:
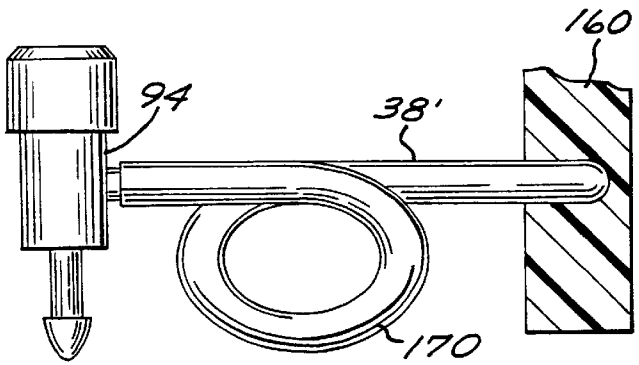
FIG. 21 is a cross-sectional view taken along line 21—21 of FIG. 20.
Figure 22:
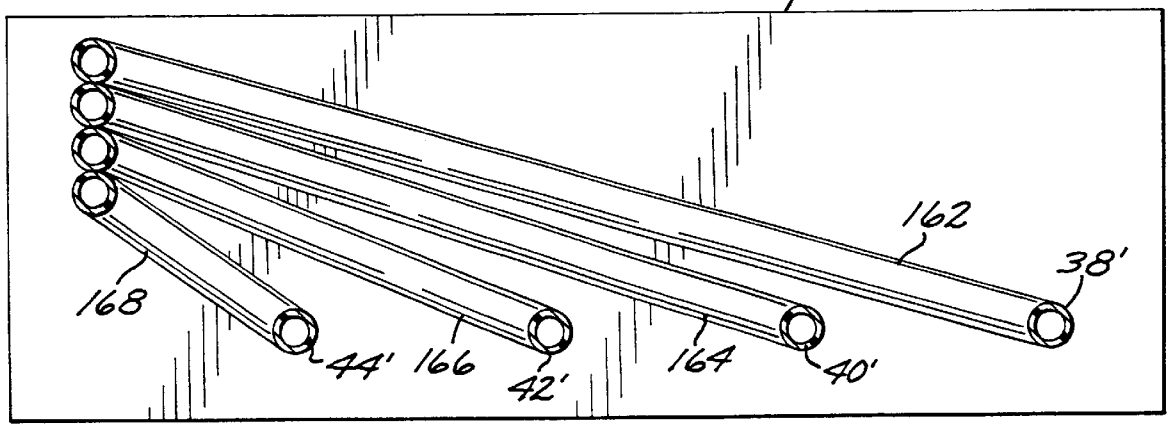
FIG. 22 is a cross-sectional view taken along line 22—22 of FIG. 20.
Figure 20:
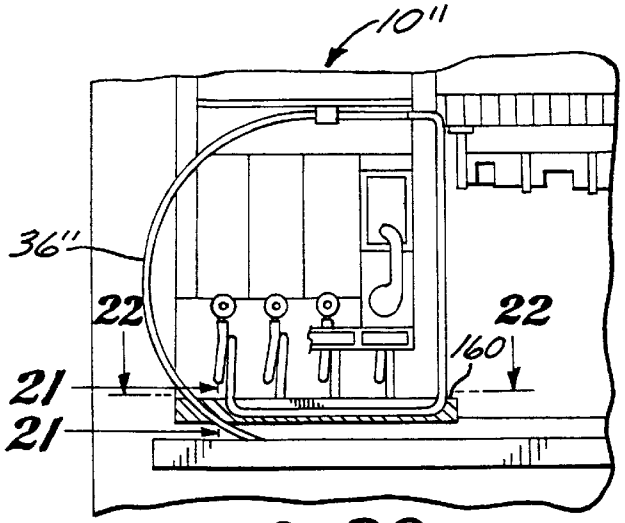
FIG. 20 is a top view of a portion of an alternate printing system embodying a tube forming feature.

FIGS. 20–22 illustrate an alternate embodiment of a fluid coupler for coupling between the ink supply station and the printing cartridges. This embodiment employs heat forming to form ends of the tubing set into shapes facilitating direct connection to the septum elbow 94, eliminating the need for a separate fluid coupler 66 and a manifold 60 as in the embodiment of FIG. 3. A further advantage is the elimination of the fluid connections for each tube, i.e. the tube-to-manifold connection and the manifold-to-coupler connection, thereby reducing ink leak risks. FIG. 20 is a top view of a portion of a printing system 10" embodying this tube forming feature, wherein the tubing set 36" has tube ends formed in the requisite shape to lead to the septum elbow 94 through a stress relief structure 160. The cross-sectional views of FIGS. 21 and 22 further illustrate the formed tube ends and the structure 160. The structure 160 is a plastic member having a plurality of channels 162–168 formed therein of a size to receive a corresponding tube 38'–44' therein in a press fit. The channels thus hold portions of the tubes in place for stress relief, with end portions of the tubes protruding therefrom for connection to the corresponding septum elbow. The protruding tube portion has a loop formed therein to provide compliance to facilitate the connection to the septum elbow. For example, as shown in FIG. 21, tube 38' has a loop 170 formed therein.

Figure 23:
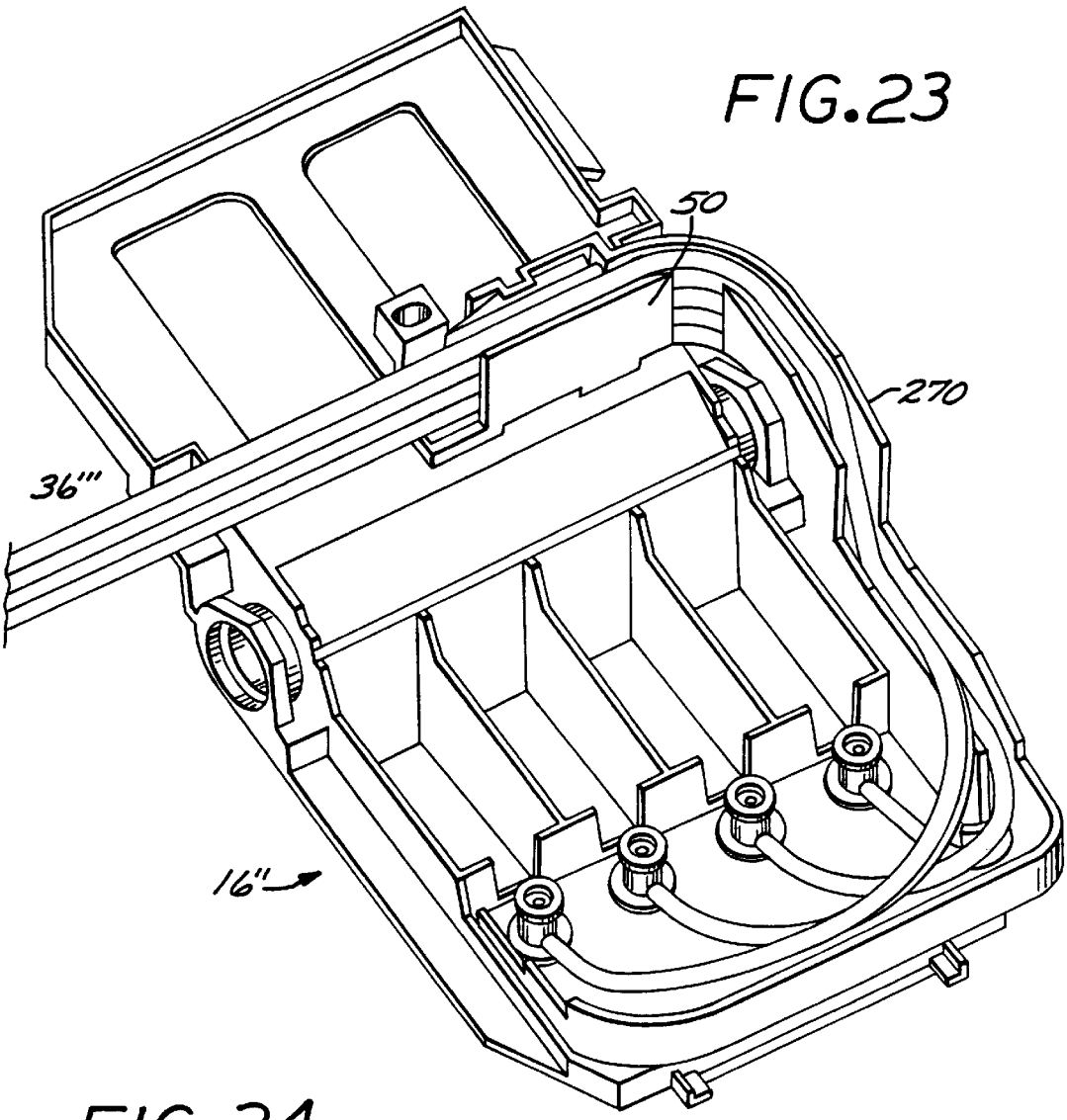
FIG. 23 is an isometric view of a further embodiment of a printer carriage and tube routing configuration.
Figure 24:
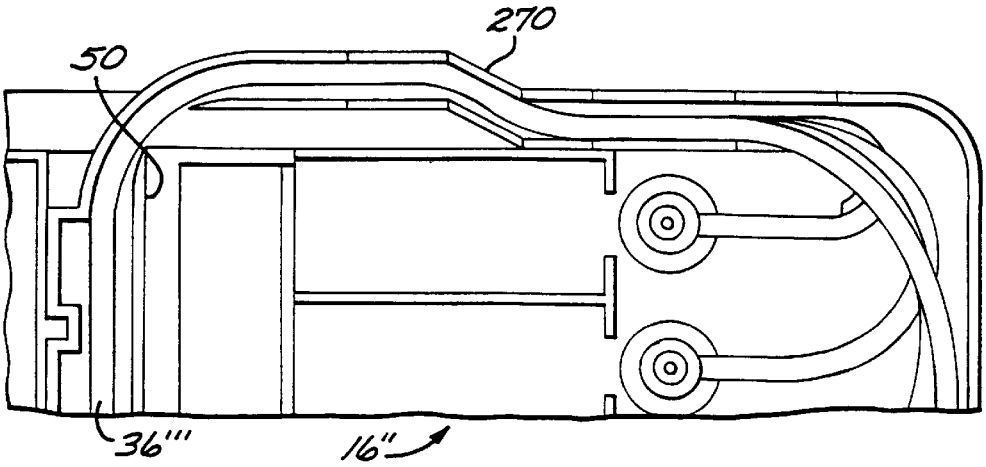
FIG. 24 is a partial top view of the printer carriage and tube routing configuration of FIG. 23.

FIGS. 23 and 24 illustrate yet another embodiment of the tube routing aspect of the invention. Here the carriage 16" is intended for use in a tube routing configuration similar to that shown in FIGS. 3–4. The carriage 16" further includes a tube routing member 270 which guides the tubing set 36'" to transition planes from the stress reliever 50 located on the top surface of the carriage down to the level of the septum elbows to which the ends of the tubes are directly connected. The tubes comprising the tubing set 36'" can be heat formed to assume the curvature shown in FIGS. 23 and 24. The embodiment of FIGS. 23 and 24 also do not require a separate ink manifold, and therefore eliminate two fluid connections per tube.

The heat forming of the tubes can be obtained by pre-shaping the tubing, holding the tubing in the preshaped position, and then heating the tubing. Hot air, radiant heating, or a hot forming tool can be used to heat the tubing. One way to obtain the proper shape is to place the tubing into the tube routing member of FIG. 23. The tubes can then be heated, e.g. by directing a hot air blast at the tubing to relieve stress.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printing system with an off-axis ink supply system, comprising:

a printer housing;

transporting system for transporting a print medium along a medium path to a print area;

a scanning carriage holding a printing cartridge, the cartridge including a printhead;

a carriage scanning apparatus coupled to the carriage for moving the carriage along a scanning axis transverse to the medium path to pass the carriage through a path of travel which defines a carriage scan swept volume;

an off-axis ink supply station mounted in a fixed position relative to the printer housing, said off-axis ink supply station is disposed on a supply station side of the scanning axis;

a fluid conduit apparatus extending between said carriage and said off-axis ink supply station to provide an ink replenishment path for said printer cartridge;

and wherein said fluid conduit apparatus is routed between said carriage and said off-axis supply station within a volume defined by said housing such that a loop is formed in said fluid conduit apparatus which dynamically flexes as the carriage is scanned along the scanning axis, wherein said fluid conduit apparatus defines a fluid path between said loop and said ink supply station which lies entirely on said supply station side of said scanning axis, said ink replenishment path includes a carriage fluid path portion, and further comprising means for providing at least a 180 degree change of direction in said carriage fluid path portion prior to a connection of said fluid path to said cartridge, said means for providing a change of direction including an ink manifold having an input port and an output port, said input port connected to an end of said fluid conduit apparatus, and further comprising an ink coupler member, said output port connected to said cartridge by said ink coupler member, and wherein a vertical projection of said dynamically flexing loop along a media path direction is substantially contained within a corresponding vertical projection of said carriage swept volume, thereby reducing space required within the printer housing to accommodate said loop and providing a compact, space-saving fluid conduit routing configuration.

2. The printing system of claim 1 wherein said carriage holds a plurality of printing cartridges for printing with liquid ink of different colors, said off-axis ink supply station includes a plurality of ink supply cartridges for holding supplies of ink of said different colors, and said fluid conduit apparatus defines a plurality of fluid conduits.

3. The printing system of claim 2 wherein said fluid conduit apparatus comprises a plurality of tubes, and a tube carrier for holding said plurality of tubes in an aligned, ribbon-like configuration throughout a portion of the length of said fluid conduit apparatus.

4. The printing system of claim 2 wherein said fluid conduit apparatus comprises a plurality of tubes fabricated in an integral unit.

5. The printing system of claim 2, wherein the ink of said different colors includes black, cyan, magenta and yellow.

6. The printing system of claim 1 wherein said off-axis ink supply station is disposed at a side of said printer housing adjacent one end of travel for said carriage, and further comprising an elongated guide member guiding the fluid conduit apparatus along an extent of an area scanned by said scanning carriage, said guide member defining an outer travel limit of the dynamically flexing loop of said fluid conduit apparatus which is bounded by the guide member on one longitudinal side of the area scanned by the carriage.

7. The printing system of claim 1 further comprising a supply of liquid ink disposed in said off-axis ink supply station.

8. The printing system of claim 1 wherein the fluid conduit apparatus includes a first fluid conduit apparatus portion and a second fluid conduit apparatus portion, and the dynamically flexing loop is defined between the first fluid conduit apparatus portion and the second fluid conduit apparatus portion, and wherein said first and said second fluid conduit apparatus portions do not vertically overlap within the carriage swept volume.

9. An ink routing system for an off-axis printer, the printer having a transporting system for transporting a print medium along a medium path, the printer also having a scanning carriage for holding a printing cartridge which includes a printhead, the carriage holding the cartridge, and a scan apparatus for scanning the carriage along a scanning axis transverse to the medium path, the printhead having at least one substantially linear row of nozzles for ejecting ink onto the print medium, the ink routing system comprising:

a fixed ink supply station; and a fluid conduit interconnecting between the ink supply station and the carriage to provide an ink replenishment path for the printer carriage, the fluid conduit including an off-axis carriage section that provides a fluid path between the supply station and a first position on the carriage, an on-carriage section that provides a fluid path between the first position on the carriage and the print cartridge, and wherein the fluid conduit is routed between the ink supply station and the carriage such that a dynamically flexing loop is formed in the fluid conduit, the loop crossing a vertical plane bisecting the row of nozzles and extending transversely to the medium path; and a stress relief member attached to the carriage to provide support to the conduit at the first position, and wherein the fluid conduit turns at least 90 degrees between the stress relief member and the ink supply station.

10. The ink routing system of claim 9, wherein the carriage scanning apparatus includes an elongated guide member for guiding the carriage along the scanning axis, and wherein the stress relief member is adjacent the elongated guide member.

11. The ink routing system of claim 9, wherein the fluid conduit crosses said vertical plane at two locations.

12. The ink routing system of claim 9 wherein the plane intersects the scanning axis.

13. The ink routing system of claim 9, further comprising a supply of liquid ink disposed in said ink supply station.

14. An ink delivery subsystem for an off-axis printer, the printer having a transporting system for transporting a print medium along a medium path to a print zone, the printer having a scanning carriage for holding a printing cartridge with a printhead such that the printhead faces the print zone, and a scanning apparatus for scanning the carriage along a scanning axis transverse to the medium path at the print zone, the cartridge having at least one substantially linear row of nozzles for ejecting ink onto the print medium, the ink delivery subsystem comprising:

an ink reservoir adapted to be releasably mounted to a fixed ink supply station;

a fluid outlet in fluid communication with the ink reservoir;

ink that travels out of the fluid outlet and through a conduit interconnecting between the ink supply station and the carriage to provide an ink replenishment path for the printer cartridge, the fluid conduit routed between the ink supply station and the carriage such that a dynamically flexing loop is formed in the fluid conduit, the loop crossing a vertical plane transverse to said medium path at two locations, the vertical plane intersecting the row of nozzles when the ink reservoir is releasably mounted in the ink supply station, and wherein the conduit includes an off-axis carriage section that provides a first fluid path between the supply station and a first position on the carriage, an on-carriage section that provides a second fluid path between the first position on the carriage and the print cartridge, and a stress relief member attached to the carriage to provide support to the conduit at the first position wherein the fluid conduit turns 90 degrees at least once between the stress relief member and the ink supply station.

15. The ink delivery subsystem of claim 14, wherein the carriage scanning apparatus includes an elongated guide member for guiding the carriage along the scanning axis, and wherein the stress relief member is adjacent to the elongated guide member.

16. The ink delivery subsystem of claim 14, further comprising a supply of liquid ink disposed in said ink reservoir.

17. A printing system with an off-axis ink supply system, comprising:

a printer housing;

transporting system for transporting a print medium along a medium path to a print area;

a scanning carriage holding a printing cartridge, the cartridge including a printhead;

a carriage scanning apparatus coupled to the carriage for moving the carriage along a scanning axis transverse to the medium path to pass the carriage through a path of travel which defines a carriage scan swept volume;

an off-axis ink supply station mounted in a fixed position relative to the printer housing, said off-axis ink supply station is disposed on a supply station side of the scanning axis;

a fluid conduit apparatus extending between said carriage and said off-axis ink supply station to provide an ink replenishment path for said printer cartridge, said fluid conduit apparatus including a hollow tubing member;

and wherein said fluid conduit apparatus is routed between said carriage and said off-axis supply station within a volume defined by said housing such that a loop is formed in said fluid conduit apparatus which dynamically flexes as the carriage is scanned along the scanning axis, wherein said fluid conduit apparatus defines a fluid path between said loop and said ink supply station which lies entirely on said supply station side of said scanning axis, said ink replenishment path includes a carriage fluid path portion, and further comprising means for providing at least a 180 degree change of direction in said carriage fluid path portion prior to a connection of said fluid path to said cartridge, said means for providing a change of direction including a direct routing of said hollow tubing member to a fitment adjacent to and in fluid communication with said cartridge, wherein said hollow tubing member is routed through said at least 180 degree change of direction, and wherein a vertical projection of said dynamically flexing loop along a media path direction is substantially contained within a corresponding vertical projection of said carriage swept volume, thereby reducing space required within the printer housing to accommodate said loop and providing a compact, space-saving fluid conduit routing configuration.

18. The printing system of claim 17 wherein an end of said tubing member is heat formed to assume a bent configuration to achieve said at least 180 degree change of direction.

19. The printing system of claim 17 further comprising a stress reliever member securing said hollow tubing member to said carriage at a stress relief location on said carriage.

20. A printing system with an off-axis ink supply system, comprising:

a printer housing;

transporting system for transporting a print medium along a medium path to a print area;

a scanning carriage holding a printing cartridge, the cartridge including a printhead;

a carriage scanning apparatus coupled to the carriage for moving the carriage along a scanning axis transverse to the medium path to pass the carriage through a path of travel which defines a carriage scan swept volume;

an off-axis ink supply station mounted in a fixed position relative to the printer housing;

a fluid conduit apparatus including a hollow tubing member, said fluid conduit apparatus extending between said carriage and said off-axis ink supply station to provide an ink replenishment path for said printer cartridge, said off-axis ink supply station disposed on a supply station side of the scanning axis, said ink replenishment path including a carriage fluid path portion means for providing at least a 180 degree change of direction in said carriage fluid path portion prior to a connection of said carriage fluid path to said cartridge, said means for providing a change of direction includes a direct routing of said hollow tubing member to a fitment adjacent to and in fluid communication with said cartridge, wherein said hollow tubing member is routed through said at least 180 degree change of direction and connects directly to said cartridge;

and wherein said fluid conduit apparatus is routed between said carriage and said off-axis supply station within a volume defined by said housing such that a loop is formed in said fluid conduit apparatus which dynamically flexes as the carriage is scanned along the scanning axis, said fluid conduit apparatus defines a fluid path between said loop and said ink supply station which crosses said scanning axis, and wherein a vertical projection of said dynamically flexing loop along a media path direction is substantially contained within a corresponding vertical projection of said carriage swept volume, thereby reducing space required within the printer housing to accommodate said loop and providing a compact, space-saving fluid conduit routing configuration.

21. The printing system of claim 20 wherein an end of said tubing is heat formed to assume a bent configuration to achieve said at least 180 degree change of direction.

22. The printing system of claim 20 further comprising a stress reliever member securing said hollow tubing member to said carriage at a securing location on said carriage.

23. A printing system with an off-axis ink supply system, comprising:

a printer housing;

transporting system for transporting a print medium along a medium path to a print area;

a scanning carriage holding a printing cartridge, the cartridge including a printhead;

a carriage scanning apparatus coupled to the carriage for moving the carriage along a scanning axis transverse to the medium path to pass the carriage through a path of travel which defines a carriage scan swept volume;

an off-axis ink supply station mounted in a fixed position relative to the printer housing;

a fluid conduit apparatus extending between said carriage and said off-axis ink supply station to provide an ink replenishment path for said printer cartridge, said off-axis ink supply station disposed on a supply station side of the scanning axis, said ink replenishment path including a carriage fluid path portion means for providing at least a 180 degree change of direction in said carriage fluid path portion prior to a connection of said carriage fluid path to said cartridge;

and wherein said fluid conduit apparatus is routed between said carriage and said off-axis supply station within a volume defined by said housing such that a loop is formed in said fluid conduit apparatus which dynamically flexes as the carriage is scanned along the scanning axis, said fluid conduit apparatus defines a fluid path between said loop and said ink supply station which crosses said scanning axis, said means for providing a change of direction includes an ink manifold having an input port and an output port, said input port connected to an end of said fluid conduit apparatus, and further comprising an ink coupler member, said output port connected to said cartridge by said ink coupler member and wherein a vertical projection of said dynamically flexing loop along a media path direction is substantially contained within a corresponding vertical projection of said carriage swept volume, thereby reducing space required within the printer housing to accommodate said loop and providing a compact, space-saving fluid conduit routing configuration.

24. An ink routing system for an off-axis printer, the printer having a transporting system for transporting a print medium along a medium path, the printer also having a scanning carriage for holding a printing cartridge which includes a printhead, the carriage holding the cartridge, and a scan apparatus for scanning the carriage along a scanning axis transverse to the medium path, the printhead having at least one substantially linear row of nozzles for ejecting ink onto the print medium, the ink routing system comprising:

a fixed ink supply station; and a fluid conduit interconnecting between the ink supply station and the carriage to provide an ink replenishment path for the printer carriage, the fluid conduit including an off-axis carriage section that provides a fluid path between the supply station and a first position on the carriage, an on-carriage section that provides a fluid path between the first position on the carriage and the print cartridge, and wherein the fluid conduit is routed between the ink supply station and the carriage such that a dynamically flexing loop is formed in the fluid conduit, the loop crossing a vertical plane bisecting the row of nozzles and extending transversely to the medium path; and a stress relief member attached to the carriage to provide support to the conduit at the first position, and wherein the fluid conduit passes through a 180 degree turn between the stress relief member and the ink supply station.

25. An ink delivery subsystem for an off-axis printer, the printer having a transporting system for transporting a print medium along a medium path to a print zone, the printer having a scanning carriage for holding a printing cartridge with a printhead such that the printhead faces the print zone, and a scanning apparatus for scanning the carriage along a scanning axis transverse to the medium path at the print zone, the cartridge having at least one substantially linear row of nozzles for ejecting ink onto the print medium, the ink delivery subsystem comprising:

an ink reservoir adapted to be releasably mounted to a fixed ink supply station;

a fluid outlet in fluid communication with the ink reservoir;

ink that travels out of the fluid outlet and through a conduit interconnecting between the ink supply station and the carriage to provide an ink replenishment path for the printer cartridge, the fluid conduit routed between the ink supply station and the carriage such that a dynamically flexing loop is formed in the fluid conduit, the loop crossing a vertical plane transverse to said medium path at two locations, the vertical plane intersecting the row of nozzles when the ink reservoir is releasably mounted in the ink supply station, and wherein the conduit includes an off-axis carriage section that provides a first fluid path between the supply station and a first position on the carriage, an on-carriage section that provides a second fluid path between the first position on the carriage and the print cartridge, and a stress relief member attached to the carriage to provide support to the conduit at the first position, and wherein the fluid conduit passes through at least a 180 degree turn between the stress relief member and the ink supply station.

* * * * *